US009352582B2

(12) United States Patent
Katayama

(10) Patent No.: US 9,352,582 B2
(45) Date of Patent: May 31, 2016

(54) COLOR ERASING APPARATUS AND METHOD FOR ERASING SELECT COLORS

(71) Applicants: KABUSHIKI KAISHA TOSHIBA, Minato Tokyo (JP); TOSHIBA TEC KABUSHIKI KAISHA, Shinagawa Tokyo (JP)

(72) Inventor: Junichi Katayama, Odawara Kanagawa (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/322,663

(22) Filed: Jul. 2, 2014

(65) Prior Publication Data

US 2016/0001572 A1 Jan. 7, 2016

(51) Int. Cl.

| | |
|---|---|
| ***B41M 7/00*** | (2006.01) |
| ***B41J 29/00*** | (2006.01) |
| ***B41J 2/32*** | (2006.01) |

(52) U.S. Cl.

CPC ..... *B41J 2/32* (2013.01); *B41M 7/0009* (2013.01); *B41J 29/00* (2013.01); *B41M 7/00* (2013.01); *B41M 7/009* (2013.01)

(58) Field of Classification Search

USPC ..... 347/179

See application file for complete search history.

(56) References Cited

U.S. PATENT DOCUMENTS

| | | | | |
|---|---|---|---|---|
| 9,046,862 | B2 * | 6/2015 | Yoshida | G03G 21/00 |
| 2010/0196063 | A1 | 8/2010 | Iguchi et al. | |
| 2012/0141154 | A1 | 6/2012 | Yoshida | |
| 2012/0315591 | A1 * | 12/2012 | Tsuchihashi et al. | 432/65 |

FOREIGN PATENT DOCUMENTS

| | | |
|---|---|---|
| JP | 2010-181883 | 8/2010 |

* cited by examiner

*Primary Examiner* — Huan Tran

(74) *Attorney, Agent, or Firm* — Patterson & Sheridan, LLP

(57) ABSTRACT

A color erasing apparatus according to an embodiment includes a color erasing unit that heats a recording medium having an image formed with a plurality of decolorable materials to a setting temperature. A controller sets the setting temperature of the color erasing unit to be lower than a highest color erasing temperature among plural color erasing temperatures of the plurality of decolorable materials, and to be equal to or higher than a lowest color erasing temperature among the plural erasing temperatures.

19 Claims, 8 Drawing Sheets

FIG. 4

| COLOR ERASING TONER | COLOR ERASING TEMPERATURE |
|---|---|
| Y | 150°C |
| M | 130°C |
| C | 110°C |
| K | 90°C |
| K | LOWEST COLOR ERASING TEMPERATURE 85°C |

COLOR ERASING APPARATUS AND METHOD FOR ERASING SELECT COLORS

FIELD Embodiments described herein relate generally to a technology for erasing colors of an image formed on a sheet.

BACKGROUND

A decolorable material is known whose colors are erased when heated up to a predetermined color erasing temperature. A sheet on which an image is formed by the decolorable material may be reused since the colors of the image are be erased when a color erasing apparatus heats the sheet up to the predetermined color erasing temperature.

However, in the above-described related art, the colors of the image may be only entirely erased, and it is not possible to partially erase the colors of the image. Accordingly, there is a need to develop a color erasing technology which may be used in various applications

DESCRIPTION OF THE DRAWINGS

FIG. 4 is chart setting forth example color erasing temperatures for each color erasing toner that may be erased in the color erasing apparatus.

DETAILED DESCRIPTION

A color erasing apparatus according to an embodiment includes a color erasing unit that heats a recording medium having an image formed with a plurality of decolorable materials to a setting temperature. A controller sets the setting temperature of the color erasing unit to be lower than a highest color erasing temperature among plural color erasing temperatures each corresponding to one of the plurality of decolorable materials and at which a color of the corresponding decolorable material is completely color erased, and to be equal to or higher than a lowest color erasing temperature among the plural erasing temperatures at which a color of the corresponding decolorable material is reduced.

Hereinafter, each of the embodiments will be described with reference to the drawings.

First Embodiment

Figure 1:
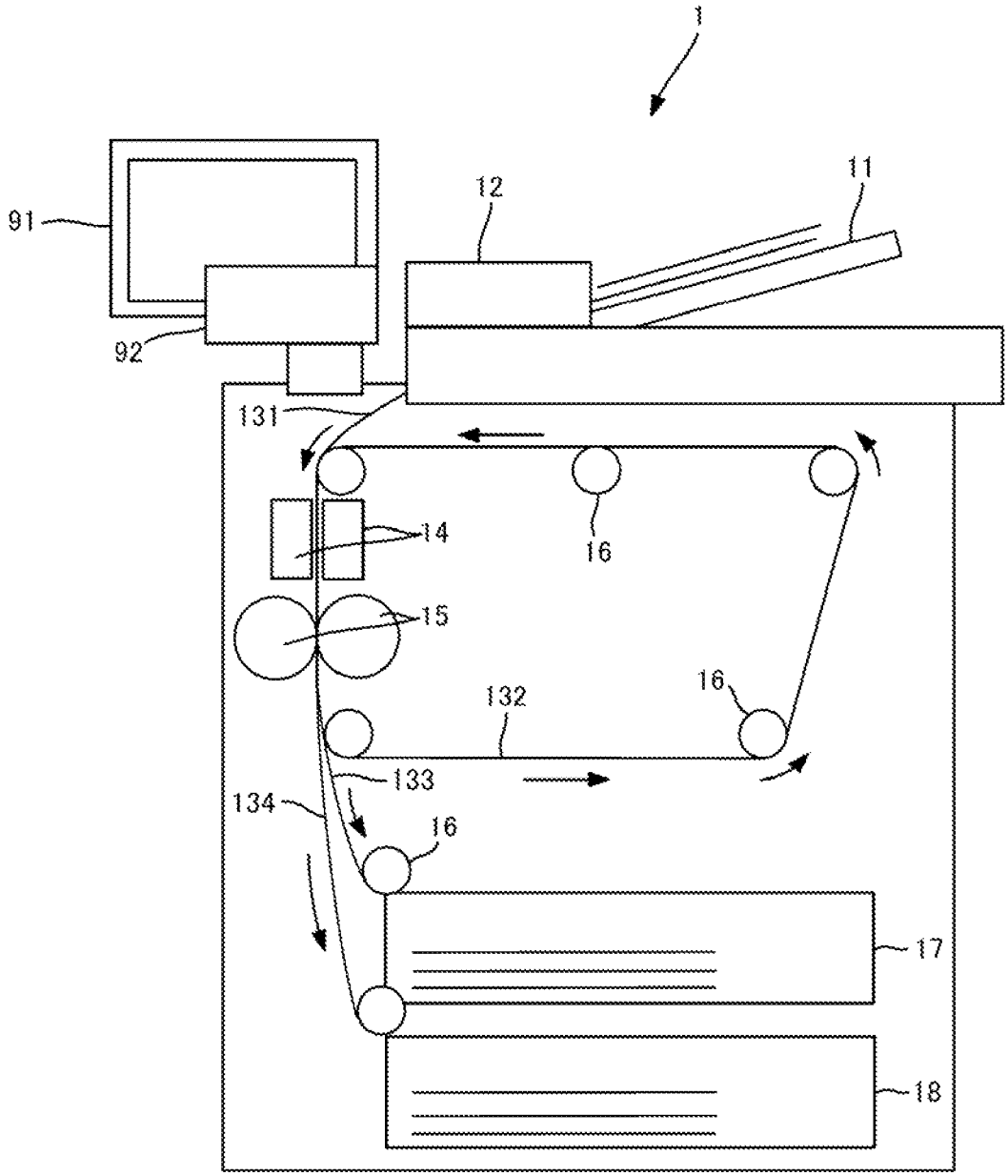
FIG. 1 illustrates an overall configuration of a color erasing apparatus.

FIG. 1 illustrates an overall configuration of a color erasing apparatus 1.

The color erasing apparatus 1 performs color erasing for erasing a color of an image on a sheet on which the image is formed of a decolorable material. The decolorable material may be a decolorable toner or a decolorable ink, or the like. The decolorable material includes a coloring compound, a color developer and a color erasing agent. For example, the coloring compound includes a leuco dye which colors in blue. For example, the color developer includes phenols. The color erasing agent includes a material which is compatible with the coloring compound if heated and has no affinity with the color developer. The decolorable material has properties such that the color is developed by interaction between the coloring compound and the color developer and the color is erased when the interaction between the coloring compound and the color developer is cut off by the decolorable material being heated at a color erasing temperature or higher. In the present embodiment, the color erasing apparatus 1 erases the color of the image on the sheet which is formed of the color erasing toner.

The color erasing apparatus 1 includes a sheet feeding tray 11, a sheet feeding unit 12, first to fourth transport routes 131 to 134, a reading unit 14, a color erasing unit 15, a transport roller 16, a reuse tray 17, a reject tray 18, a display 91 and an operation unit 92.

The sheet feeding tray 11 stacks the sheets on which the image is formed of the color erasing tone. The color erasing apparatus 1 causes the sheet feeding unit 12 to transport the sheet on the sheet feeding tray 11 to the second transport route 132 , which circles back to the first transport route 131. The reading unit 14 includes a charge coupled device (CCD). The color erasing apparatus 1 causes the reading unit 14 to read the image on both surfaces of the sheet prior to a color erasing process, and stores the read image in a HDD 23 (to be described later, with reference to FIG. 3). A user may obtain the image prior to the color erasing process from the HDD 23.

Figure 2:
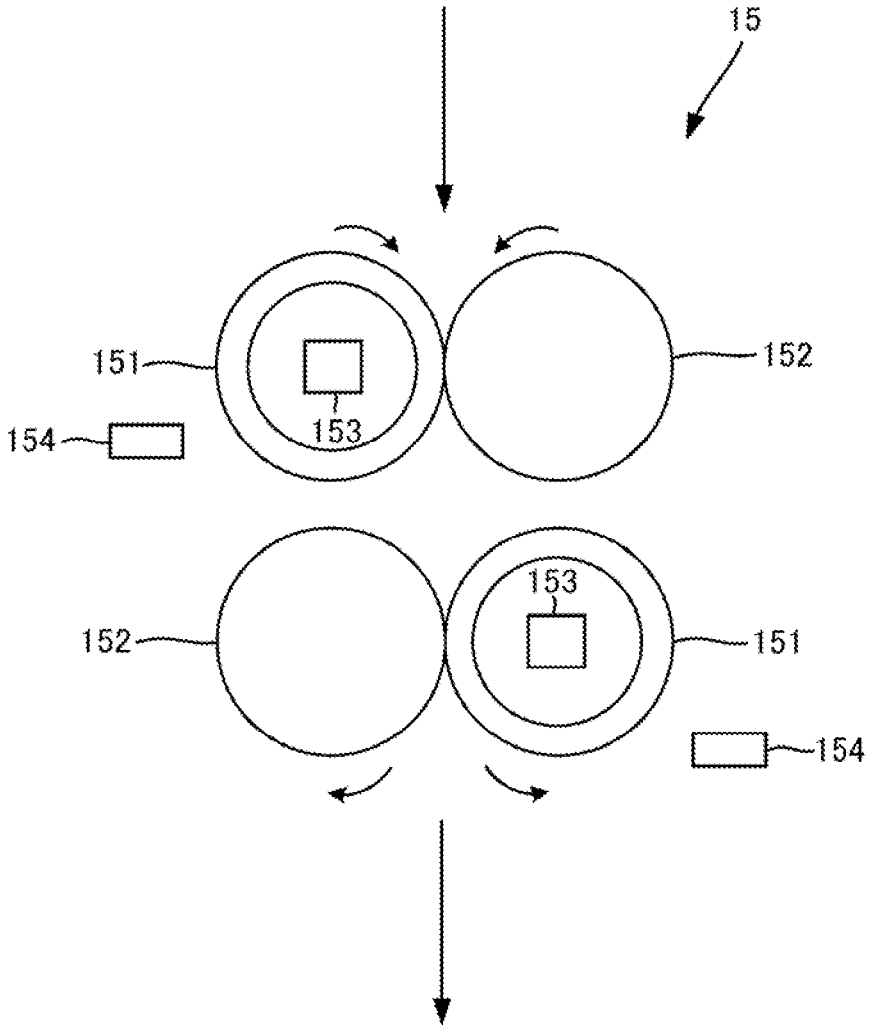
FIG. 2 illustrates a configuration of a color erasing unit of the color erasing apparatus.

FIG. 2 illustrates a configuration of the color erasing unit 15.

The color erasing unit 15 includes a pair of heat rollers 151 which respectively come into contact with a sheet surface. The color erasing unit 15 also includes a pair of press rollers 152, each coming into pressurizing contact with one of the heat rollers 151. One heat roller 151 comes into contact with one surface of the sheet and the other heat roller 151 comes into contact with the other surface of the sheet. Each heat roller 151 internally has a heater 153 for heating the heat roller 151. A temperature sensor 154 of a non-contact type for detecting a temperature of the respective heat roller 151 is disposed around each heat roller 151. The color erasing apparatus 1 heats the heat roller 151 up to a setting temperature by adjusting an output of the heater 153. The color erasing apparatus 1 causes the color erasing unit 15 to heat the sheet, thereby erasing the color of the image on the sheet.

Referring back to FIG. 1, the color erasing apparatus 1 re-transports the sheet in which the color of the image is erased to the reading unit 14 via the second transport route 132, and causes the reading unit 14 to read the images on both surfaces of the sheet. The third transport route 133 leading to the reuse tray 17 and the fourth transport route 134 leading to the reject tray 18 branch from the second transport route 132. A flapper (not illustrated) which distributes the sheets to each branched transport route is disposed in each branch point in the transport route of the color erasing apparatus 1. In addition, transport rollers 16 for transporting the sheet is disposed at appropriate position on the first to fourth transport routes 131 to 134.

Based on the image read from both surfaces of the sheet after the color erasing process, the color erasing apparatus 1 determines whether the sheet is reusable. The sheet is determined to be reusable if both surfaces have no visible portions subjected to color erasing left. The sheet is determined to be not reusable if a visible portion subjected to color erasing is left on either surface. If the sheet is determined to be reusable, the color erasing apparatus 1 discharges the sheet to the reuse tray 17 from the second transport route 132 the third transport route 133. If the sheet is determined not to be reusable, the color erasing apparatus 1 discharges the sheet to the reject tray 18 from the second transport route 132 via the fourth transport route 134.

The display 91 is a touch panel or the like. The display 91 displays a screen and also includes an operation unit 92 which receives an input from a user.

The operation unit 92 includes buttons or keys, and receives the input from the user.

Figure 3:
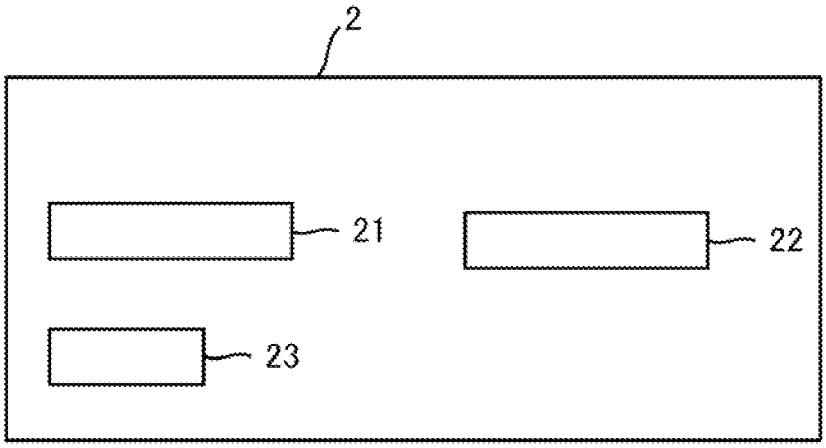
FIG. 3 is a block diagram illustrating a configuration of a controller of the color erasing apparatus.

FIG. 3 is a block diagram illustrating a configuration of a controller 2 of the color erasing apparatus 1.

The controller 2 controls the entire color erasing apparatus 1. The controller 2 includes a processor 21, a memory 22 and a hard disk drive (HDD) 23, and controls the entire color erasing apparatus 1. The processor 21 fulfills various functions of the color erasing apparatus 1 by executing programs stored in the memory 22 or the HDD 23.

FIG. 4 is a chart setting forth example color erasing temperatures for each color erasing toner that may be erased in the color erasing apparatus.

In the present embodiment, the color erasing apparatus 1 performs the color erasing process on an image formed of a plurality of color erasing toners. The respective color erasing toners have colors different from each other. The colors of the respective color erasing toners are yellow (Y), magenta (M), cyan (C) and black (K). In addition, the respective color erasing toners each have different color erasing temperatures which are setting temperatures of the color erasing unit 15 for completing the color erasing. The color erasing temperature for the color erasing toner of Y is 150° C., for example. The color erasing temperature for the color erasing toner of M is 130° C., for example. The color erasing temperature for the color erasing toner of C is 110° C. for example. The color erasing temperature for the color erasing toner of K is 90° C., for example. A fixing temperature for the respective color erasing toners of Y, M, C and K is lower than 90° C., and for example, is 70° C.

The color development of the color erasing toner is reduced when the color erasing process is performed at a temperature slightly lower than the color erasing temperature, but the color erasing toner may not completely become colorless. In this disclosure, the description of "completing color erasing" means that image density (ID) of the color erasing toner (image density obtained by only a certain color erasing toner) is 25% or less after the color erasing toner is heated at a certain temperature. The color erasing temperatures of the respective color erasing toners of Y to K in FIG. 4 represents a temperature at which the color is "completely color erased".

In addition, in this disclosure, the description of "the color erasing process" includes a process where the image density of the color erasing toner becomes 75% or less when the color erasing toner is heated at a certain temperature, that is, a process where the color erasing is not completed. The description of "reduced" means that the image density of the color erasing toner may be 75% or less when the color erasing toner is heated at a certain temperature.

In the present embodiment, for example, a temperature which reduces the color development of the color erasing toner of K (which has the lowest color erasing temperature of 90° C.) is 85° C. Hereinafter, the temperature is referred to as the lowest color erasing temperature in some cases.

In the present embodiment, as illustrated in FIG. 4, the setting temperature of the color erasing unit 15 is set to be 90° C.—the color erasing temperature for K—which is the lowest color erasing temperature among the color erasing temperatures for the color erasing toners of Y to K. Through the color erasing process at the setting temperature 90° C., it is possible to complete the color erasing only for the color erasing toner of K. Thus, it is possible to complete the color erasing only for the color component of K in the image. In addition, it is possible to reduce the color development of the color component of K by setting the setting temperature of the color erasing unit 15 to be 85° C.

In the present embodiment, it is possible to erase the colors of the color components of K and C whose color erasing temperature is 110° C. or less by setting the setting temperature of the color erasing unit 15 to be 110° C. (a temperature for completing color erasing for the color erasing toners of K and C). In this manner, in the present embodiment, it is possible to concurrently erase the colors of at least two or more color erasing toners among four color erasing toners of Y to K by setting the setting temperature of the color erasing unit 15 to be 110° C., for example.

In the present embodiment, it is possible to erase the colors of all color components of Y to K by setting the setting temperature of the color erasing unit 15 to be 150° C.—the color erasing temperature of Y—which is the highest color erasing temperature among the color erasing temperatures of the respective color erasing toners.

In the present embodiment, the color erasing apparatus 1 may set the setting temperature of the color erasing unit 15 to be lower than the highest color erasing temperature (150° C.) among the respective color erasing temperatures of the plurality of color erasing toners, and to be higher than the lowest color erasing temperature (85° C.) which may reduce the color development of the color erasing toner of K which has the lowest color erasing temperature (90° C.)

In this manner, for example, if the color component of a portion of the image is only K, when the color erasing apparatus 1 sets the setting temperature of the color erasing unit 15 to be 90° C.—which is the color erasing temperature of K—it is possible to erase the color for the portion of the image formed of only the color component of K.

In the present embodiment, the setting temperature of the color erasing unit 15 is set to be in a range that is lower than the highest color erasing temperature (150° C.) among the respective color erasing temperatures of the plurality of color erasing toners and higher than the lowest color erasing temperature (85° C.) which may reduce the color development of the color erasing toner of K which has the lowest color erasing temperature (90° C.). In this manner, it is not necessary to complete the color erasing for all color components, and thus it is possible to erase the color of a desired color component.

In the present embodiment, a user may select the color component for the color erasing by using a selection receiving screen 8 (to be described later, with reference to FIG. 6). The color erasing apparatus 1 performs the color erasing process by setting the setting temperature of the color erasing unit 15 according to the color component received by the selection receiving screen 8.

Hereinafter, in conjunction with a color erasing method using the color erasing apparatus 1, an example of the selection receiving screen 8 for the color erasing of the color component will be described.

Figure 5:
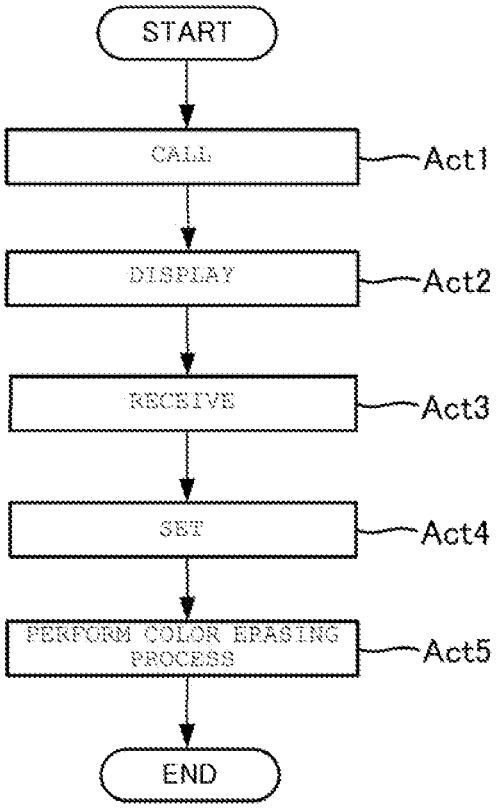
FIG. 5 is a flowchart setting forth example operations for a color erasing method using the color erasing apparatus.

FIG. 5 is a flowchart setting forth example operations for the color erasing method using the color erasing apparatus 1.

The controller 2 of the color erasing apparatus 1 causes the operation unit 92 to receive a call for the selection receiving screen 8 for selecting the color component from a user (Act 1). The selection receiving screen 8 is then displayed on the display 91 (Act 2).

Figure 6:
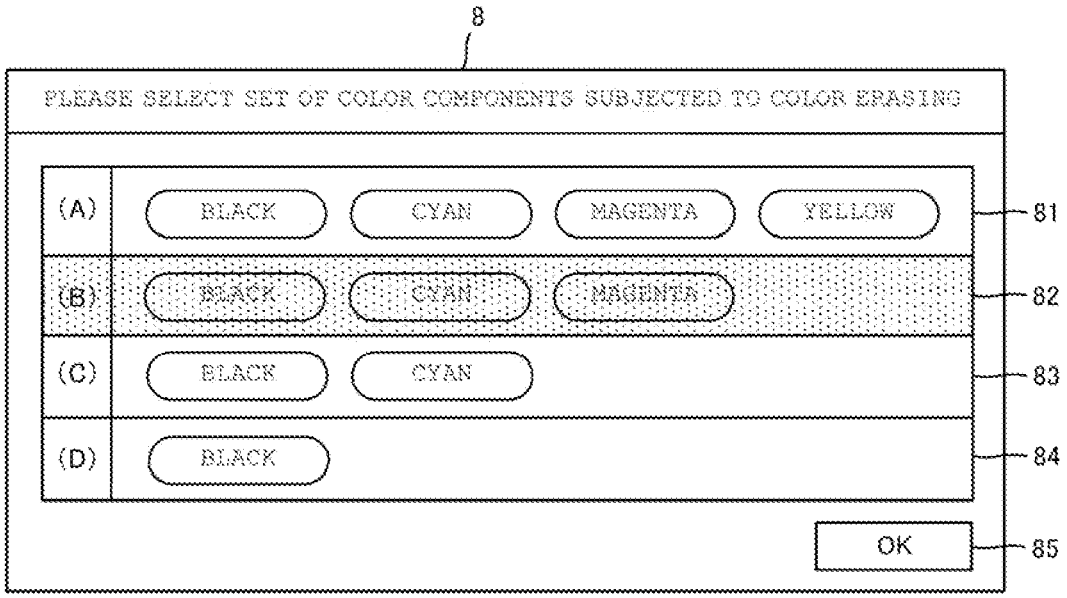
FIG. 6 illustrates a selection receiving screen for use in the color erasing apparatus, according to a first embodiment.

FIG. 6 illustrates the selection receiving screen 8.

The selection receiving screen 8 has rows 81 to 84 for a set of the color components of the color erasing toners whose colors are erased at the respective color erasing temperatures, for each color erasing temperature (150° C., 130° C., 110° C., or 90° C.) of the respective color erasing toners. The row 81 displays a set of the color components of Y to K whose colors are erased at the color erasing temperature (150° C.) for the color erasing toner of Y. The row 81 displays a set of the color components of Y to K whose colors are erased, that is, yellow, magenta, cyan and black. Similarly, the row 82 displays a set of the color components of M to K (magenta, cyan and black) whose colors are erased at the color erasing temperature (130° C.) of the color erasing toner of M. The row 83 displays a set of the color components of C and K (cyan and black) whose colors are erased at the color erasing temperature (110° C.) of the color erasing toner of C. The row 84 displays the color component of K (black) whose color is erased at the color erasing temperature (90° C.) for the color erasing toner of K.

In the present embodiment, the rows 81 to 84 for the sets of the respective color components are arranged in order of higher color erasing temperature corresponding to the set (150° C., 130° C., 110° C. and 90° C.)

If a user touches any one of the rows 81 to 84 and then touches an OK button 85, or if the user inputs selection by operating the operation unit 92, the controller 2 receives the selection of one of the rows 81 to 84 for the set of the color components whose or the user wants to erase (Act 3).

The controller 2 sets the setting temperature of the color erasing unit 15 to be the color erasing temperature corresponding to the set which the user selects (Act 4). As illustrated in FIG. 6, if the user selects the row 82 for example, the controller 2 sets the setting temperature of the color erasing unit 15 to be 130° C. of the color erasing temperature corresponding to the set of the row 82.

The controller 2 then causes the color erasing unit 15 to be heated to the setting temperature received by the selection receiving screen 8, to thereby heat the image on the sheet and to erase the color for the received set of the color components in the image (Act 5). For example, if the user selects the row 82 on the selection receiving screen 8, the color erasing unit 15 heats the image on the sheet at 130° C. of the color erasing temperature corresponding to the set of the row 82 (magenta, cyan and black) to erase the colors of the color components of magenta, cyan and black from the image on the sheet. In this manner, it is possible to erase the colors of the color components of magenta, cyan and black from the image, thereby leaving only the color component of yellow in the image.

Second Embodiment

Figure 7:
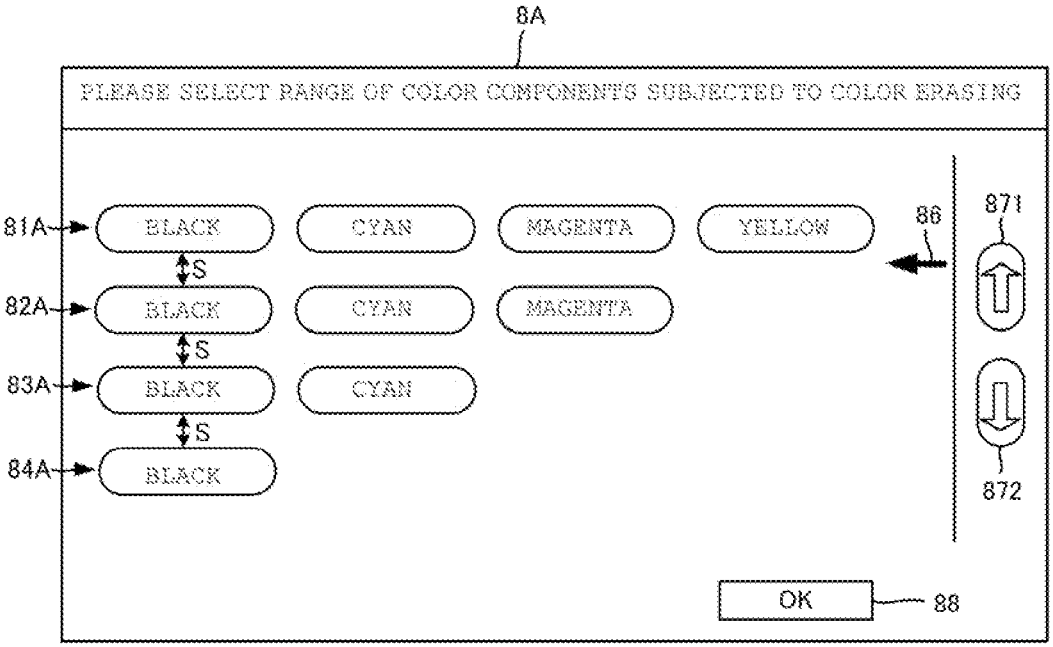
FIG. 7 illustrates another selection receiving screen for use in the color erasing apparatus, according to a second embodiment.

FIG. 7 illustrates another selection receiving screen 8A, according to a second embodiment.

In the second embodiment, the controller 2 receives a set of colors which a user wants to erase through a selection receiving screen 8A in FIG. 7. On the selection receiving screen 8A, Sets 81A to 84A of the color components of the color erasing toners whose colors are erased at the respective color erasing temperatures are displayed horizontally in one row for each color erasing temperature (150° C., 130° C., 110° C. and 90° C.) of the color erasing toners. The sets 81A to 84A of the respective color components are arranged in order of higher color erasing temperature (150° C., 130° C., 110° C. and 90° C.) corresponding to the sets 81A to 84A, and are arranged vertically leaving a gap S between each other.

On the selection receiving screen 8A, a cursor 86 for designating a range of the color components subjected to color erasing and movement buttons 871 and 872 for moving the cursor 86 vertically are disposed on the right side of the sets 81A to 84A of the color components. In addition, the selection receiving screen 8A has on OK button 88 for determining the range of the color components subjected to color erasing according to a vertical position of the cursor 86. According to the vertical position of the cursor 86, the setting temperature of the color erasing unit 15 which is to be designated varies. As the cursor 86 is positioned higher, the setting temperature of the color erasing unit 15 which is to be designated becomes higher.

On the selection receiving screen 8A, if the cursor 86 designates the vertical position as corresponding to any one of the sets 81A to 84A of the color components, the range subjected to color erasing shows the color components of the set.

On the selection receiving screen 8A, if the cursor 86 designates a region between two of the sets 81A to 84A of any color component (for example, a region between the sets 81A and 82A), the range subjected to color erasing also includes the color component (yellow) having the color erasing temperature (150° C.) corresponding to the upper side set (for example, 81A) in addition to the respective color components (magenta, cyan and black) of the lower side set (for example 82A). In this case, the range becomes the designated range which reduces the color development of the color component (yellow) having the color erasing temperature corresponding to the upper side set (for example, 81A). Hereinafter, description will be made in detail.

In the present embodiment, on the selection receiving screen 8A, a vertical region between two of sets 81A to 84A of the color components is a region which corresponds to an input of the temperature between two of the color erasing temperatures corresponding to the sets 81A to 84A of the respective color components. For example, if the cursor 86 designates the region between the sets 81A and 82A, as the setting temperature of the color erasing unit 15, the controller 2 receives the temperature according to the vertical position of the cursor 86 which is the temperature between 150° C. of the color erasing temperature corresponding to the set 81A and 130° C. of the color erasing temperature corresponding to the set 82A.

Here, 150° C. of the color erasing temperature corresponding to the set 81A is the color erasing temperature for Y (yellow). Accordingly, if the cursor 86 designates the vertical position slightly below the set 81A, the temperature slightly lower than 150° C. of the color erasing temperature for Y is designated as the setting temperature of the color erasing unit 15. It is possible to reduce the color development of the color erasing toner of Y by setting the setting temperature of the color erasing unit 15 to be the temperature slightly lower than 150° C. of the color erasing temperature for Y.

Accordingly, in the present embodiment, the cursor 86 designates the region between two of the sets 81A to 84A of the color components. In this manner, it is possible to reduce the color development of the color component (for example, Y) corresponding to the color erasing temperature of the set positioned above (for example, the set 81A). Further, it is possible to set the setting temperature of the color erasing unit 15 to be the temperature which completes the color erasing for the color components (for example, M, C and K) of the set positioned (for example, 82A).

Modification Example

On the selection receiving screen 8A, the sets of the color components subjected to color erasing may be arranged in order of lower color erasing temperature corresponding to the sets.

The setting temperature of the color erasing unit 15 may be input directly through input from the touch panel of the display 91 or through input from the operation unit 92.

The controller 2 may cause the memory 22 to store a history of a range of the color components whose color a user selects to erase. Then, if the user instructs the start of the color erasing process without setting the setting temperature of the color erasing unit 15, the controller 2 may perform the color erasing process by setting the setting temperature of the color erasing unit 15 to be the setting temperature corresponding to the range of the color components whose color the user most frequently selects to erase.

The color erasing apparatus 1 may set the setting temperature of the color erasing unit 15 for the image containing a plurality of color erasing toners which respectively have different color erasing temperatures (for example, color erasing toners Y to K) and a plurality of non-decolorable toners which have different colors (for example, non-decolorable toners of Y to K). The setting temperature may be lower than the highest color erasing temperature (150° C.) among the respective color erasing temperatures. (for example, 150° C., 130° C., 110° C. and 90° C.) of the plurality of color erasing toners, and so as to be equal to or higher than the temperature (for example, 85° C.) which reduces the color development of the color erasing toner (K) having the lowest color erasing temperature (90° C).

Figure 8:
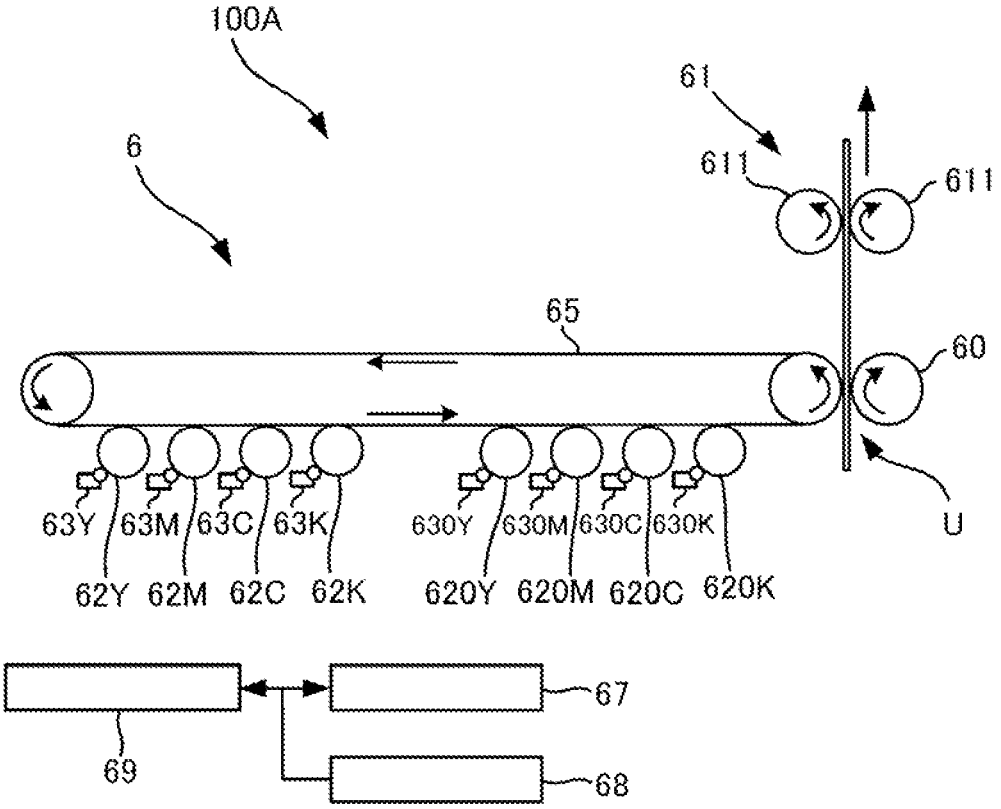
FIG. 8 illustrates a configuration of an image forming apparatus that functions as the color erasing apparatus.

FIG. 8 illustrates a configuration of an image forming apparatus 100A which also functions as the color erasing apparatus.

The image forming apparatus 100A includes an image forming unit 6 which may form an image by a plurality of color erasing toners, an image by non-decolorable toners and an image by both of the color erasing toners and the non-decolorable toners on the sheet.

In the image forming unit 6, developing units 630Y to 630K are used in developing the non-decolorable toners of Y to K, and developing units 63Y to 63K are used in developing the color erasing toners of Y to K. The color erasing toners of Y to K are similar to the color erasing toners described in the respective embodiments, and respectively have the different color erasing temperatures of 150° C., 130° C., 110° C. and 90° C., for example.

Photoreceptor drums 620Y to 620K and the developing units 630Y to 630K are positioned between photoreceptor drums 62Y to 62K and a secondary transfer position U in a rotating direction of a transfer belt 65. The secondary transfer position U as a position where a secondary transfer roller 60 forms a nip with the transfer belt 65. The positions of the photoreceptor drums 620Y to 620K and the developing units 630Y to 630K and the positions of the photoreceptor drums 62Y to 62K and the developing units 63Y to 63K may be reversed.

The image forming unit 6 forms an electrostatic latent image on the photoreceptor drums 620Y to 620K and 62Y to 62K by using a laser unit (not illustrated) and causes the developing units 630Y to 630K and 63Y to 63K to develop the electrostatic latent image by using the non-decolorable toner and the color erasing toner. The image forming unit 6 transfers a developed toner image to a sheet at the secondary transfer position U via the transfer belt 65.

After causing the image forming unit 6 to form the toner image on the sheet, the image forming apparatus 100A sends the sheet to a fixing unit 61. The image forming apparatus 100A sends the sheet to unit 61 to heat the sheet and to fix the toner image on the sheet. As described above, the image forming apparatus 100A may form the image by using the color erasing toners of Y to K whose color erasing temperatures are different from each other and by using the non-decolorable toners of Y to K.

Incidentally, the fixing unit 61 includes a heat roller 611 (which is similar to the heat roller 151 in the above embodiments), and also functions as the color erasing unit. This enables the image forming apparatus 100A to perform the color erasing process of the color erasing toner components.

Similar to the above embodiments, a controller 69 of the image forming apparatus 100A first displays the selection receiving screen 8 in FIG. 6, for example, on a display 67. An operation unit 68 receives a user's selection of a range of the color component whose color the user desires to erase. Then, the image forming apparatus 100A sets the temperature (130° C.) corresponding to the set of the received color components (for example, the row 82 in FIG. 6) to be the setting temperature of the fixing unit 61.

Then, the image forming apparatus 100A removes the sheet on which the image having the plurality of color erasing toner components is formed from a tray (not illustrated), and transports the sheet to the fixing unit 61 by passing the sheet through the image forming unit 6 and the secondary transfer position U. The image forming apparatus 100A heats the sheet by using the fixing unit 61 functioning as the color erasing unit which is adjusted to have the setting temperature. This enables the image forming apparatus 100A to erase the color components in the received range.

The order of each process in the embodiments may be different from the order which is described as an example in the embodiments.

As described above, according to the technology disclosed in this disclosure, it is possible to provide a technology for erasing only certain colors of an image formed on a sheet.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A color erasing apparatus comprising:

a color erasing unit configured to heat a recording medium;

a display that displays plural different sets, each set including one or more of a plurality of decolorable materials, and each of the decolorable materials having an erasing temperature at which a color thereof is erased;

an input interface configured to accept an input selecting one of the sets; and a controller configured to set a setting temperature of the color erasing unit to be equal to or higher than a highest erasing temperature of the decolorable materials in the selected set, and to be lower than a lowest erasing temperature of decolorable materials that are not in the selected set.

2. The apparatus according to claim 1, wherein the display shows the plural different sets of decolorable materials in order from a set having a highest erasing temperature to a set having a lowest erasing temperature.

3. The color erasing apparatus according to claim 2, wherein a position on the input interface is selected to specify the selected set and the selected set is displayed at or lower than, with respect to the order of the sets, the selected position.

4. The apparatus according to claim 1, wherein the different decolorable materials include different colors and the colors are yellow, magenta, cyan and black.

5. The apparatus according to claim 1, wherein the color erasing unit includes a heat roller configured to contact the recording medium.

6. The apparatus according to claim 1, wherein the decolorable materials are each a color erasable toner.

7. The apparatus according to claim 1, further comprising:

an image forming unit configured to form the image formed with the plurality of decolorable materials on the recording medium, wherein the color erasing unit is further configured to fix the image formed with the plurality of decolorable materials at a fixing temperature lower than a lowest erasing temperature of the different decolorable materials.

8. The color erasing apparatus according to claim 1, wherein the input interface accepts inputs from one of a keyboard and a touch-sensitive panel on the display.

9. The apparatus according to claim 1, wherein each of the decoloring materials has a different erasing temperature.

10. A color erasing method for erasing an image formed on a recording medium with a plurality of decolorable materials each having an erasing temperature at which a color thereof is erased, the method comprising the steps of:

displaying, on a display, plural different sets, each set including one or more of the different decolorable materials;

accepting, via an input interface, an input selecting one of the sets; and setting a setting temperature of a color erasing unit to be equal to or higher than a highest erasing temperature of the decolorable materials in the selected set, and to be lower than a lowest erasing temperature of decolorable materials that are not in the selected set.

11. The method according to claim 10, wherein the display shows the plural different sets of decolorable materials in order from a set having a highest erasing temperature to a set having a lowest erasing temperature.

12. The color erasing method according to claim 11, wherein a position on the input interface is selected to specify the selected set, and the set corresponding to the selected position is displayed at or lower than, with respect to the order of the sets, the selected position.

13. The method according to claim 10, wherein:

the different decolorable materials include different colors and the colors are yellow, magenta, cyan and black, and the decolorable materials are each a color erasable toner.

14. The method according to claim 10, wherein the color erasing unit includes a heat roller that comes into contact with the recording medium when the recording medium is conveyed through the color erasing unit.

15. The method according to claim 10, wherein the color erasing unit fixes the image formed with the plurality of decolorable materials at a fixing temperature lower than a lowest erasing temperature of the different decolorable materials.

16. The color erasing method according to claim 10, wherein the input interface accepts inputs from one of a keyboard and a touch-sensitive panel on the display.

17. The color erasing method according to claim 10, wherein the each of the decoloring materials has a different erasing temperature.

18. The color erasing apparatus according to claim 17, wherein the second position is higher on the display than the first position.

19. A color erasing apparatus comprising:

a color erasing unit configured to heat a recording medium;

a display that displays a first set and a second set, each set including one or more of a plurality of decolorable materials, and each of the decolorable materials having an erasing temperature at which a color thereof is erased;

an input interface configured to accept an input selecting a position on the display; and a controller configured to set a setting temperature of the color erasing unit to a highest erasing temperature of the decolorable materials in the first set, if the selected position is a first position, set the setting temperature of the color erasing unit to a highest erasing temperature of the decolorable materials in the second set, which is higher than the highest erasing temperature of the decolorable materials in the first set, if the selected position is a second position, and set the setting temperature of the color erasing unit to be higher than the highest erasing temperature of the decolorable materials in the first set and lower than the highest erasing temperature of the decolorable materials in the second set if the selected position is a position between the first position and the second position.

* * * * *